US009174258B2

(12) United States Patent
Freitag et al.

(10) Patent No.: US 9,174,258 B2
(45) Date of Patent: Nov. 3, 2015

(54) APPARATUS AND PROCESS FOR FORMING PROFILES WITH A VARIABLE HEIGHT BY MEANS OF COLD ROLLING

(75) Inventors: Stefan Freitag, Sauerlach (DE); André Abee, Valley (DE); Albert Sedlmaier, Holzkirchen (DE)

(73) Assignee: DATA M SOFTWARE GMBH, Valley Oberlaindern (DE)

( * ) Notice: Subject to any disclaimer, the term of this patent is extended or adjusted under 35 U.S.C. 154(b) by 1196 days.

(21) Appl. No.: 12/747,477

(22) PCT Filed: Dec. 10, 2008

(86) PCT No.: PCT/EP2008/010468

§ 371 (c)(1),
(2), (4) Date: Nov. 17, 2010

(87) PCT Pub. No.: WO2009/074299

PCT Pub. Date: Jun. 18, 2009

(65) Prior Publication Data

US 2011/0088444 A1 Apr. 21, 2011

(30) Foreign Application Priority Data

Dec. 10, 2007 (DE) ..... 10 2007 059 439

(51) Int. Cl.
*B21D 5/08* (2006.01)

(52) U.S. Cl.
CPC ..... *B21D 5/083* (2013.01)

(58) Field of Classification Search
USPC ..... 72/167, 168, 179, 214–220, 231, 237, 72/240, 252.5, 347, 348, 101, 180–182
See application file for complete search history.

(56) References Cited

U.S. PATENT DOCUMENTS

| | | | | |
|---|---|---|---|---|
| 4,098,107 | A * | 7/1978 | Bruno | 72/237 |
| 4,558,577 | A * | 12/1985 | Trishevsky et al. | 72/12.7 |
| 5,722,278 | A | 3/1998 | Horino et al. | |
| 6,990,841 | B2 * | 1/2006 | Desousa et al. | 72/101 |
| 7,409,844 | B2 * | 8/2008 | Ingvarsson | 72/167 |
| 7,721,579 | B2 * | 5/2010 | Bartlett et al. | 72/179 |
| RE42,417 | E * | 6/2011 | Hayes | 72/240 |
| 2004/0040357 | A1 * | 3/2004 | Ingvarsson et al. | 72/181 |
| 2004/0112103 | A1 | 6/2004 | Gorski | |
| 2010/0083722 | A1 * | 4/2010 | Bachthaler et al. | 72/237 |

FOREIGN PATENT DOCUMENTS

| | | | |
|---|---|---|---|
| DE | 10011755 | A1 | 9/2001 |
| DE | 102004040257 | A1 | 12/2005 |
| WO | 2007/008152 | A1 | 1/2007 |

OTHER PUBLICATIONS

Written Opinion from International Application Publication No. WO 2009/074299 (English version).
International Search Report from International Application Publication No. WO 2009/074299.

* cited by examiner

*Primary Examiner* — Shelley Self
*Assistant Examiner* — Pradeep C Battula
(74) *Attorney, Agent, or Firm* — Lisa V. Mueller; Michael Best & Friedrich LLP

(57) ABSTRACT

A cold roll forming apparatus for forming a variable profile. The apparatus comprises a forming unit having a least one adjustment stand which includes a roll stand with a pair of rollers between which the sheet metal strip is passed through along its longitudinal direction (X), wherein the roll stand is translationally and rotationally displaceable during the cold roll forming with at least one translatory degree of freedom and one rotary degree of freedom being independent from each other.

11 Claims, 15 Drawing Sheets

APPARATUS AND PROCESS FOR FORMING PROFILES WITH A VARIABLE HEIGHT BY MEANS OF COLD ROLLING

CROSS-REFERENCE TO RELATED APPLICATIONS

This is the U.S. national stage entry of International Patent Application No. PCT/EP2008/010468, filed on Dec. 10, 2008, which claims priority to German Patent Application No. 10 2007 059 439.0, filed Dec. 10, 2007, the contents of all of which are hereby incorporated by reference.

TECHNICAL FIELD

The present invention is directed in general to an apparatus and a method for cold roll forming of profiles with varying heights, and in particular to an apparatus and a method according to the preambles of claims 1 and 12.

PRIOR ART

In the industrial field, in particular in the automotive industry, in many cases V- and U-profiles are used, e.g. for reinforcing the car body, as beams or axles. These profiles often have a non-constant height, or depth, and of course need not be symmetrical. Examples of profiles with varying heights, or depths, are shown in FIGS. 1A to 4C, wherein FIGS. 1A to 1C show different views of a U-profile with a depression 1, FIGS. 2A to 2C show different views of a U-profile with a raising 2, FIGS. 3A to 3C show different views of a U-profile comprising a depression and a raising and having constant leg height, and FIGS. 4A to 4C show different views of a V-profile having a depression 1. As shown in the front view of the FIGS. 1C, 2C, and 3C, from which the run of the varying heights can be seen between the lines 3 and 4, the U-profiles shown therein have a constant width. The V-profile of FIG. 4C has a varying height and a varying width 33.

Traditionally, profiles of the previously described type are produced by presses, so that any change of length and shape of a profile entails an expensive adaptation of the press.

Moreover, there are known "dummy" profiles having varying height, wherein a flexible forming of the profile is done in the width so that first the small side elements 5 are formed and then the long legs 6 are bent upwards, as shown in FIGS. 10A and 10B. By doing so, it is only possible to cover a very small range of profiles having varying heights.

From DE 100 11 755 A1, an apparatus and a method for producing a profile by means of cold roll forming according to the preambles of claims 1 and 12, respectively, are known. Therewith, profiles having a cross sections varying over the length direction can be produced by moving the adjustment stands not only transversely to the longitudinal direction of the profile during the forming process, but also the rolling tools are positioned tangentially to the desired run of the bending edge of a profile. Thereto, the adjustment stand is allowed, in addition to the possibility for adjustment transversely to the longitudinal direction of the profile, a rotational movement about an axis perpendicular to the sheet metal strip feeding plane. In practice, this apparatus is only suitable for producing profiles with varying widths, since for profiles with varying heights, it would be necessary to simultaneously perform movements in five degrees of freedom. Thereto, for each of these degrees of freedom, a motorized drive would have to be provided, and it would be necessary to design every single one of these drives stronger than the maximum deformation resistance to be overcome. Furthermore, the moving range for every single degree of freedom would have to be large, in particular for profiles having major variability of height, and the control would be very complicated. Accordingly, producing profiles with varying height is not even considered in this publication. This also applies for an apparatus equally of this generic type which is known from DE 10 2004 040 257 A1.

From U.S. Pat. No. 3,051,214 A, there are known an apparatus and a method for cold roll forming of a profile with a cross section with equal height over the length of the profile, but with varying width. Moreover, the profile can be provided with constant curvature over the length of the profile.

DISCLOSURE OF THE INVENTION

The object of the present invention is to provide an apparatus and a method by which it is possible to inexpensively produce profiles having a cross section with varying height over the length. Besides, a relatively large range of profiles having varying heights is to be covered.

This object is achieved for an generic apparatus and a corresponding method by the characterizing features of the claims 1 and 12, respectively. Advantageous embodiments of the invention are given in the dependent claims.

The present invention is not limited to profiles having a constant width and/or to V- and U-profiles, the more so as they can be advantageously used in connection with various symmetric and asymmetric profiles of constant and of varying width.

BRIEF DESCRIPTION OF THE DRAWINGS

Below, embodiments of the present invention are described referring to the drawings. The drawings show.

DETAILED DESCRIPTION OF THE INVENTION

Figure 5:
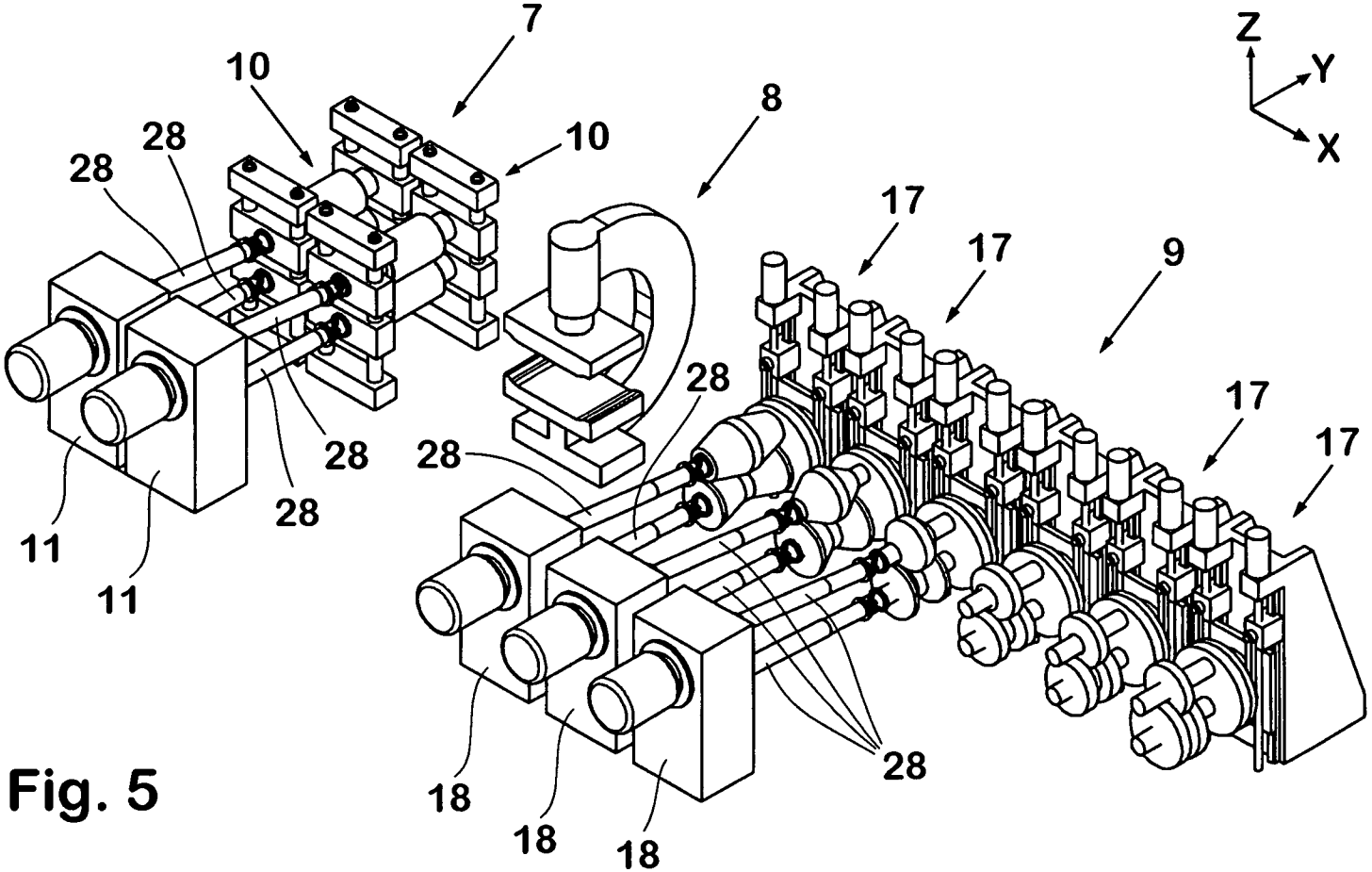
FIG. 5 a schematic perspective view of an apparatus according to the invention for cold roll forming of profiles with varying height.

Referring to FIG. 5, now a perspective view of an apparatus according to the invention for cold roll forming of profiles with varying heights is described.

Figure 1B:
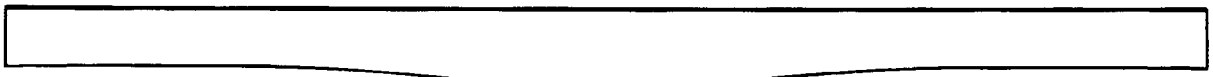
FIG. 1B a side view of the longitudinal side of the U-profile of FIG. 1A.
Figure 1A:
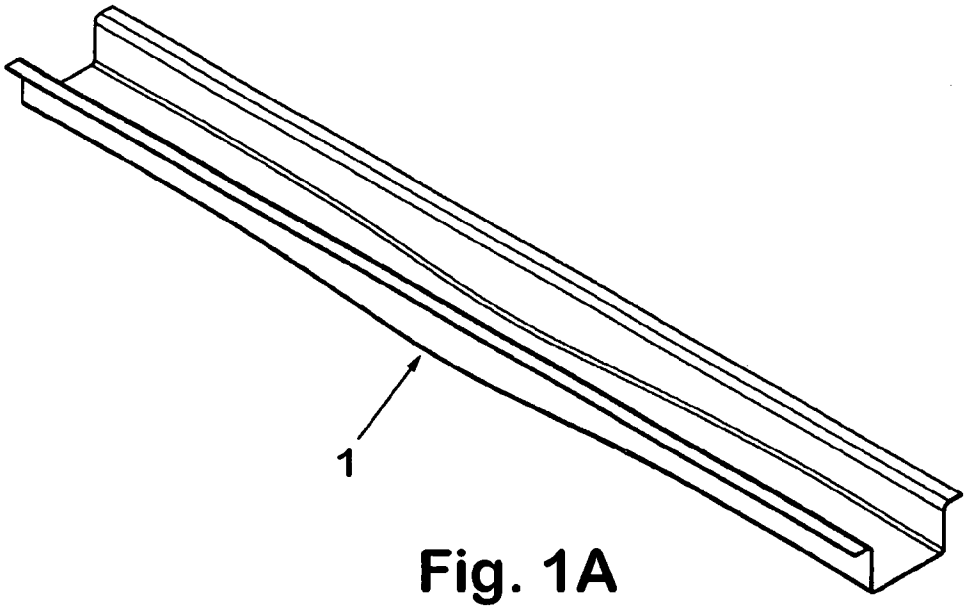
FIG. 1A a perspective view of an U-profile having varying height with a depression which can be produced according to the apparatus and the method of the present invention.
Figure 1C:
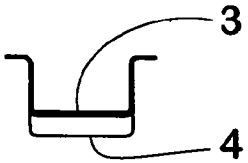
FIG. 1C a front view of the U-profile of FIG. 1A.
Figure 2B:
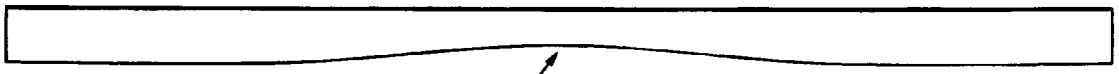
FIG. 2B a side view of the longitudinal side of the U-profile of FIG. 2A.
Figure 2A:
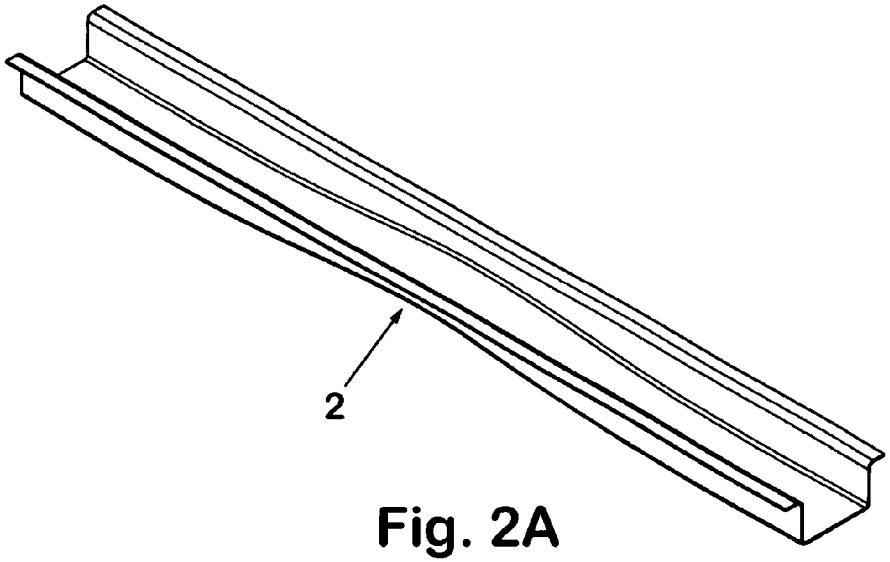
FIG. 2A a perspective view of a U-profile having varying height with a raising which can be produced according to the apparatus and the method of the present invention.
Figure 2C:
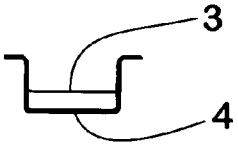
FIG. 2C a front view of the U-profile of FIG. 2A.
Figure 3B:
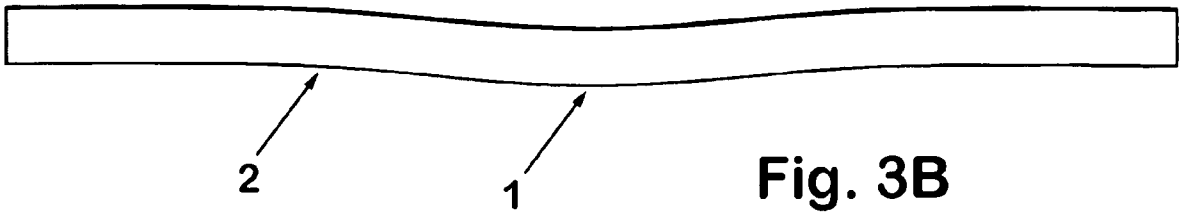
FIG. 3B a side view of the longitudinal side of the U-profile of FIG. 3A.
Figure 3A:
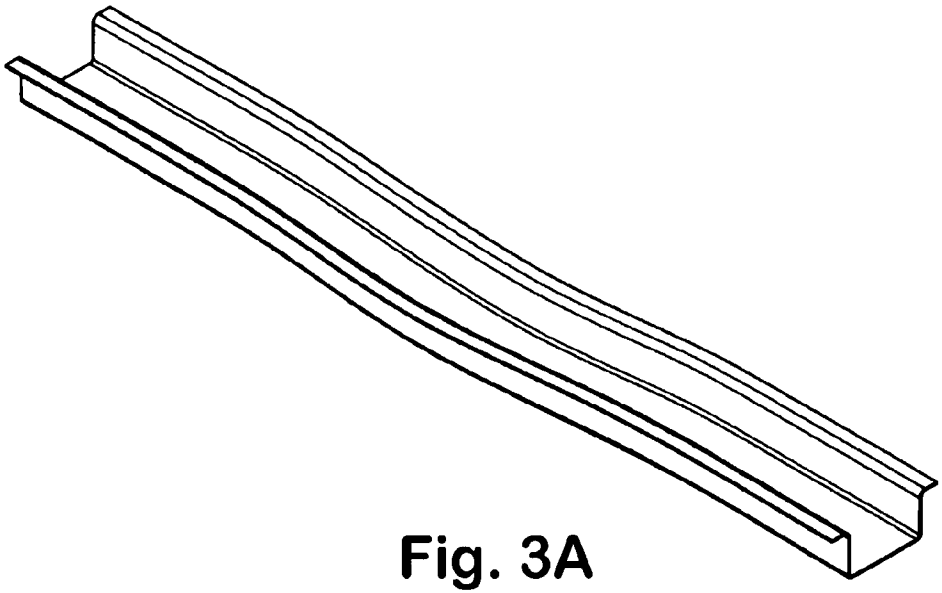
FIG. 3A a perspective view of an U-profile having varying height with a depression and a raising which can be produced according to the apparatus and the method of the present invention.
Figure 3C:
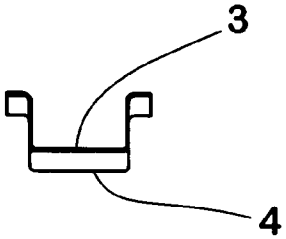
FIG. 3C a front view of the U-profile of FIG. 3A.
Figure 4B:
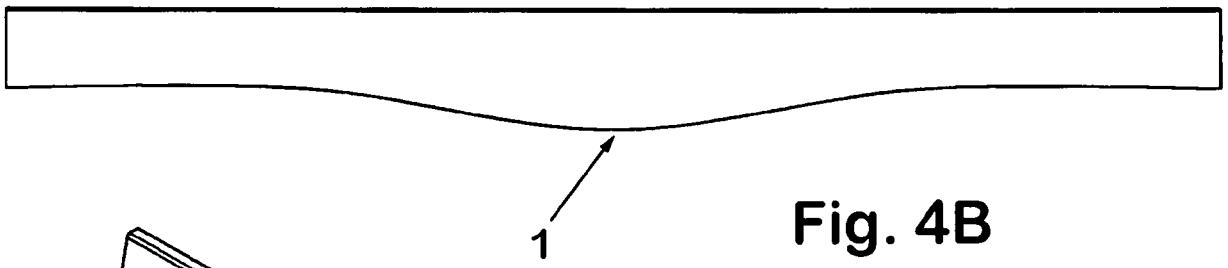
FIG. 4B a side view of the longitudinal side of the U-profile of FIG. 1A.
Figure 4A:
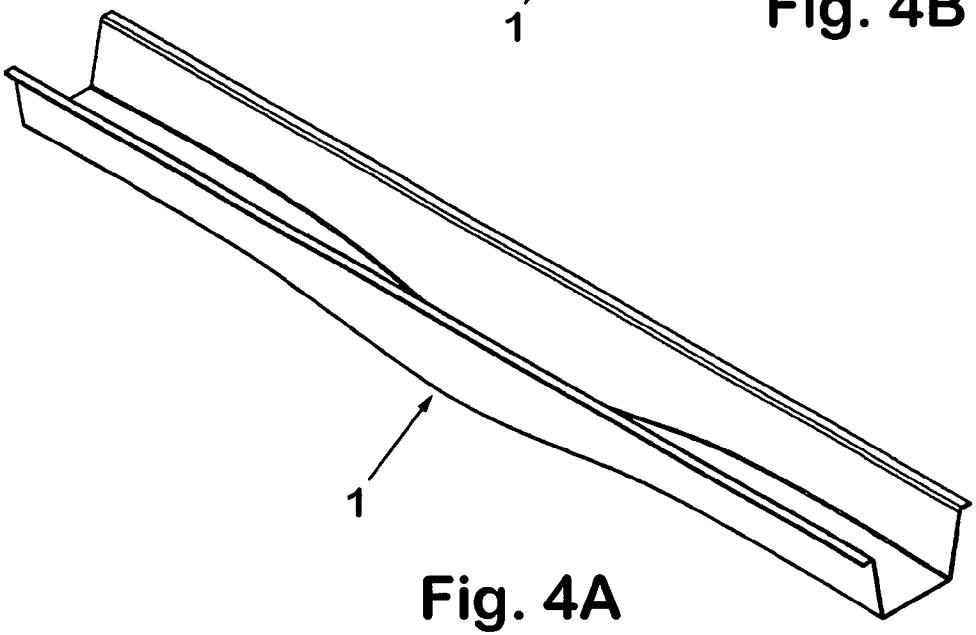
FIG. 4A a perspective view of an U-profile having varying height and varying width with a depression which can be produced according to the apparatus and the method of the present invention.
Figure 4C:
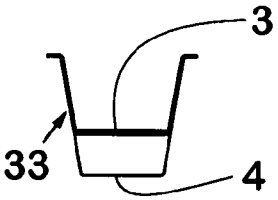
FIG. 4C a front view of the U-profile of FIG. 1A in which the varying width can be seen clearly.

In the context of this patent application, the expression "varying height" is to be construed so that the height of the profile is changing, as seen in its longitudinal direction. Also, the profile is produced so that the bottom of the finished profile is not passed through the cold roll forming apparatus with it staying in the same plane, but its bottom is provided with depressions and raisings. Moreover, the profile of the FIGS. 3A to 3C is a profile varying in height. Of course, the profile can be produced in an upside-down position.

The apparatus for cold roll forming comprises a (not shown) unit for cutting-to-size the sheet metal strips in the width direction, e.g. by laser beam, plasma, water jet, by cutting roll pairs which are rotated and linearly moved, a rapid cutting devise, nibbling shears or sheet shears with short cutting length, wherein the cutting may be performed in the end; a driving unit designated by reference numeral 7, a depressing/raising unit designated with reference numeral 8; and a forming unit 9.

The apparatus for cold roll forming can moreover include, upstream from the driving unit 7, the following conventional generic components, which are not shown:

- a decoiler which usually is embodied as a reel on which the planar sheet metal strip is wound;
- a straightening unit for flattening the strip;
- a strip storage means which is usually embodied as a pit, for compensating speed differences; and
- a pre-punching unit with a subsequent strip storage means.

Moreover, the apparatus for cold roll forming can, downstream from the forming unit 9, comprise the following conventional generic components, which are not shown:

- a post-punching unit for forming beads, embossings or additional openings;
- a welding machine for closed or welded profiles;
- means for removing the supernatant of the weld seem and for removing buns;
- a sizing station for achieving accurate dimensions;
- a cutting-to-size unit, as "flying saw" or pneumatically or hydraulically operated punching means from the stationary or traveling type; and
- further equipment for performing processes such as bending.

Moreover, there can be downstream devices for forming the U- and V-profiles into a top-hat profile which are used especially for the automotive industry. For top-hat-profiles ⊔ and ¯_/¯, the flange (¯) can be formed in a subsequent forming process. In these station(s), a combination of stationary and movable rolls is used. The side flanges are formed by stationary rolls. The support at the bottom is suitably done by roll pairs which also can be moved with two degrees of freedom.

The driving unit 7 comprises at least one stand 10 for the transport of the sheet metal strip and at least one motorized gear drive 11 which drives corresponding rolls of the stand 10 via shafts 28. In the embodiment illustrated in an exemplary manner, there are shown two stands, wherein a person skilled in the art understands that the number of the stands can be higher or lower, as the need arises. The driving unit 7 arranged upstream from the depressing/raising unit 8 functions to prevent a backwards pulling force before a possible depression/raising and to compensate a change in length of the sheet metal strip in the depressing/raising unit 8.

FIGS. 6A to 6D show several embodiments of the depressing/raising unit 8 of FIG. 5. According to the invention, it is not necessary to provide the depressing/raising unit 8 since the profiles with varying heights can be produced by using solely the forming unit 9. In case the depressing/raising unit 8 according to the invention is used, it exhibits certain advantages in connection with the forming unit 9, if deeper profiles with varying depths are to be produced and/or if the length of the forming unit 9 is to be limited.

Again referring to FIG. 6A to 6D, the depressing/raising unit 8 can adopt various embodiments for realizing depressions and raisings in the sheet metal strip to be profiled, such that, already before the actual profile forming takes place, the depression and the raising of the bottom is formed into the sheet metal strip.

Figure 6D:
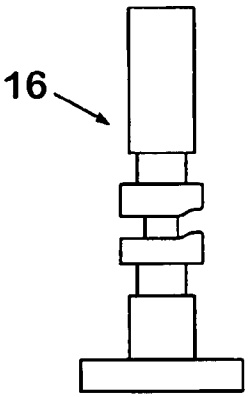
FIGS. 6A to 6D several embodiments of the depression/raising unit of FIG. 5.
Figure 6C:
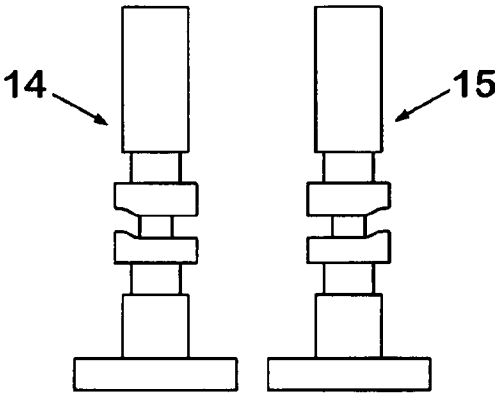
Figure 6B:
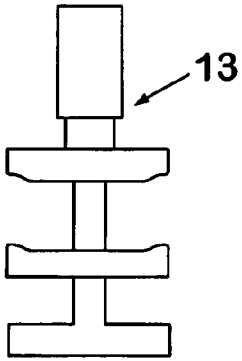
Figure 6A:
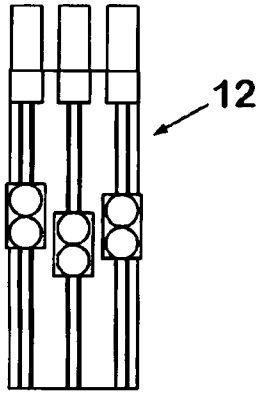

A possible embodiment as 3-roll bending machines 12 is shown in FIG. 6A, wherein, as a person skilled in the art understands, as well 4- or 6-roll bending machines can be used. In the embodiment of FIG. 6A, the depression and the raising, respectively, can be formed in the sheet metal strip by the arrangement of the roll pairs of the roll bending machines which are lifted and lowered. It is however also possible to use tree pairs of cylindrical rolls which are lifted and lowered for pre-forming the strip in a convex and a concave manner.

The embodiment of FIG. 6B is devised as a hydraulic press 13 with a suitable depressing tool so that a depression can be pre-formed in the sheet metal strip. This embodiment corresponds to the unit 8 shown in FIG. 5.

The embodiment of FIG. 6C is devised as a pair of hydraulic presses 14 and 15 with a suitable tool for depressing and raising so that a depression and a raising can be pre-formed in the sheet metal strip.

The embodiment of FIG. 6D is devised as a press 16 with a rotating tool for, preferably servo-hydraulically, depressing and raising so as to form a depression or a raising in the sheet metal strip by the press.

All previously shown presses can be supported in a stationary or flying manner, to depending on whether the forming of the profile takes place continuously or discontinuously. Again referring to FIG. 5 together with FIGS. 7A and 7B, the forming unit 9 will be described in greater detail. The forming unit 9 consists of a plurality of adjustment stands 17 whose rolls are driven with a respective motorized drive 18 via a corresponding shaft 28. For simplification, the motorized drives of the first three adjustment stands in FIG. 5A are shown.

Figure 7B:
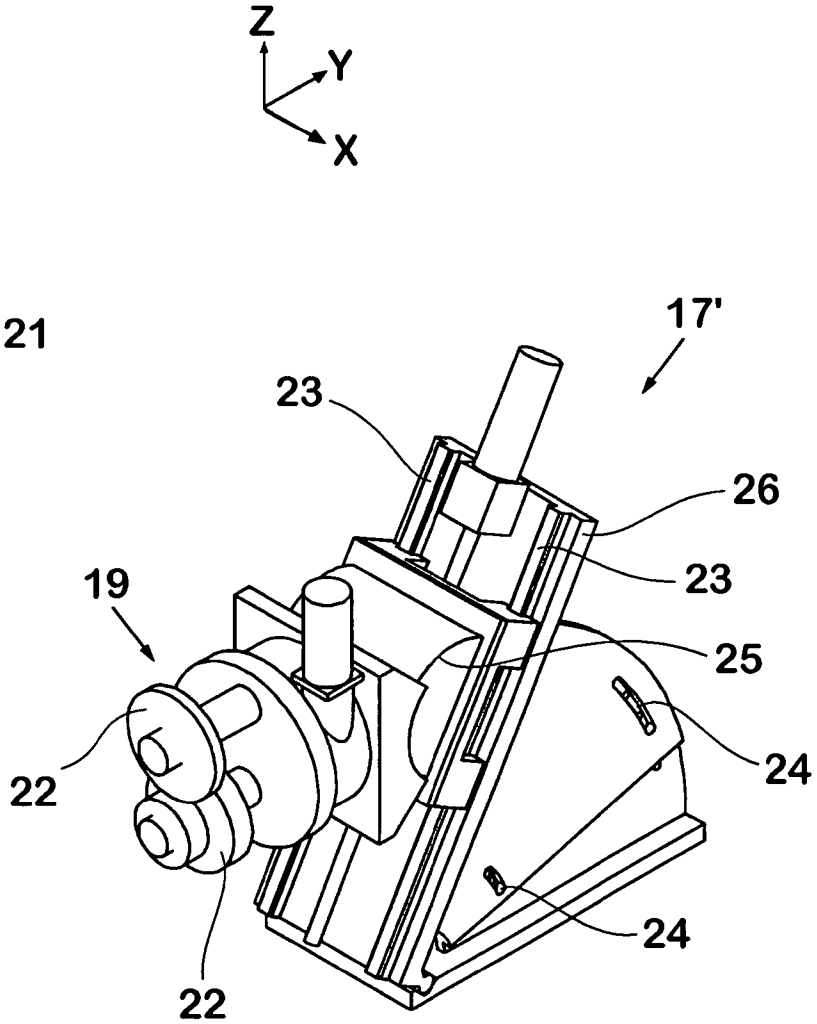
FIG. 7B another embodiment of an adjustment stand of the forming unit of FIG. 5.
Figure 7A:
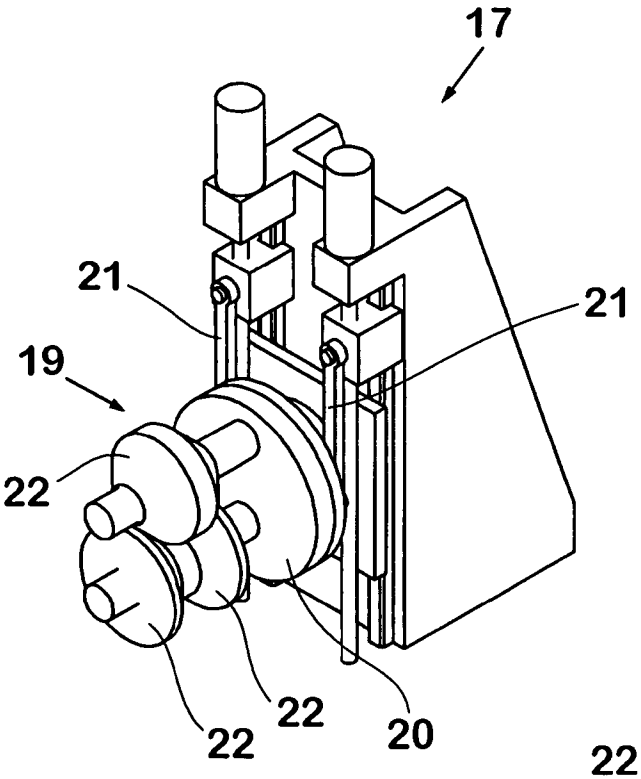
FIG. 7A an embodiment of an adjustment stand of the forming unit of FIG. 5.

In FIG. 7A, an adjustment stand 17 for parallel kinematics is shown which is preferably formed as Bi-Pod or rather Duopod. The Duopod is described in greater detail in the German patent application DE 10 2007 011 849 A1 which is included herein by reference. The Duopod allows two degrees of freedom by means of one translational and one rotational movement. The translational degree of freedom is achieved by moving of a roll stand (roller stand) 19 having a base plate 20 by means of actuating two push rods 21 in the same direction, wherein the base plate carries two rolls 22 having parallel axes, between which rolls exists an elongate gap through which the sheet metal strip is passed in the length direction X. Thus, the translational movement takes place in the Z-direction shown in FIG. 7A. The rotational degree of freedom is implemented by actuating the two push rods 21 in opposite directions so that the roll stand 19 is rotated about the rotation axis of the base plate 20, wherein the gap between the rolls 19 is kept stationary. Said rotation axis is hereinafter referred to as rotational axis of the roll stand. In the embodiments of FIGS. 7 and 8, the rotation axis of the roll stand 19 is running with parallel axis to and between the two rolls 22, but it may extend more or less oblique in relation to them, as will later be explained referring to examples, wherein in such cases the position of the gap between the rolls 22 is somewhat displaced when a rotation of the roll stand 19 is carried out. For better understanding, the coordinate system XYZ is given in FIG. 5, wherein X indicates the sheet metal strip transport direction. By the arrangement described above, the translational degree of freedom and the rotational degree of freedom are independent from each other.

By the translational movement of the roll stand 19 of the Bi-Pod or Duopod 17 of FIG. 7A, the edges of the sheet metal strip can be raised so that finally a profile with a varying height, or depth, is produced. If only a translational movement of the roll stand 19 in the Z-direction is allowed and the rotation axis of the roll stand 19 is to parallel to the Y-axis, a profile with a constant width is produced.

By means of the rotational movement of the roll stand 19 of the Bi-Pod or Duopod 17 of FIG. 7A, the rolls 22 can be rotated or pivoted together about the rotation axis of the roll stand 19 during the cold roll forming so that the rolls are moved tangentially relative to the surface of the sheet metal strip. Thus, in this operation mode of the Bi-Pod or Duopod 17, an accidental collision of the rolls 22 and the surface of the sheet metal strip is prevented. In certain embodiments, the forces resulting from such a collision may be wanted to achieve a greater force to press onto the surface of the sheet metal strip for achieving an additional depression or raising. The control of the Bi-Pod or Duopod 17 can be accomplished by means of a COPRA Adaptive Motion Control (which is a product of the applicant of the present invention). By the Bi-Pod or Duopod 17 of the apparatus of FIG. 5A, V- or U-shaped profiles with varying height or depth can be produced. However, only profiles having constant width can be produced.

The adjustment stand 17 of FIGS. 5 and 7A, respectively, can be replaced by an adjustment stand 17' for parallel kinematics whereby profiles with varying height and varying width can be produced both as U- and V-profile. Such an adjustment stand 17' is shown in FIG. 7B, in which, in contrast to FIG. 7A, the push rods 21 are replaced by a pair of guides 23 which are mounted on a common plate. Thus, the base plate 20 of the rolls 22 can be turned with an adjustable angle in the YZ-plane. The mechanism for adjusting the angle for the guides 23 is shown schematically in FIG. 7B with reference numeral 24, and for a person skilled in the art no further explanation is needed.

Moreover, the position of the base plate 20 can be set along an circular arc 25, whereby another degree of freedom is achieved, so that it is e.g. possible, as will be subsequently explained referring to FIG. 8, in spite of the inclination of the plate carrying the guides 23, to align the axes of the rolls 22 parallel to the Y-direction.

The adjustment stands 17' are, as shown in FIG. 8, arranged in pairs one after another in a staggered manner, wherein a pair of adjustment stands 17' constitutes a bending station of the forming unit 9.

Basically, the adjustment stands 17 and 17' can be operated for producing profiles with varying height and constant width, or profiles with varying height and varying width.

For producing profiles with varying height and constant width, the inclination of the plate carrying the guides 23 is set vertically so that the adjustment stands 17' act in a fashion similar to the adjustment stands 17.

For producing profiles with varying height and varying width, the inclination of the plate carrying the guides 23 must be set independently for each bending station pair so as it follows the inclination angle of the edges of the sheet metal strip. This means that the inclination of the plate carrying the guides 23 is to follow the varying inclination angle of the edge to be bent at each bending station pair. It is understood that in case of profiles with varying heights and varying widths the inclination is less than 90°. According to the invention, the adjustment of the inclination of the plate carrying the guides 23 is carried out either in accurate concordance with the inclination angle of the edge to be bent or by correcting the inclination of said plate by additionally taking into consideration the centrical elongation, as will be explained below referring to FIGS. 9E to 9H. The varying width of the profile is achieved at each bending station pair by displacing the base plate 20 on the inclined guides 23 so that the distance of the roll pairs 22 to the longitudinal center line of the sheet metal strip (its longitudinal center line in the sheet metal strip transport direction) is changed. At the same time, by this movement of the roll pairs 22 the varying depth is achieved.

The previously described adjustment stand 17' allows for one translational movement and one degree of freedom in the YZ-plane. The rotational movement or rather said degree of freedom of the adjustment stand 17' can be implemented by actuating an arm by a (not shown) linear drive, in analogy to the above mentioned DE 100 11 755 A1, and thus is not explained here in greater detail.

In case that symmetrical V- or U-profiles with varying height and constant width are to be produced by the adjustment stand 17', the control is carried out in analogy to that of the adjustment stand 17, wherein the translational movement occurs in Z-direction and the rotational movement is also implemented by turning the base plate 20 about its rotation axis. In this case also, the control can be performed such that accidental collisions of the roll pairs 22 and the surface of the sheet metal strips are prevented, or on purpose there is provoked a collision of the roll pairs 22 and the surface of the sheet metal strip for an additional deforming of it.

In case that symmetrical or asymmetrical V- or U-profiles with varying height and varying width are to be produced by the adjustment stand 17', in addition a shift of the adjustment stand 17' in Y-direction perpendicular to the Z-direction and to the sheet metal strip transport direction X has to be initiated, e.g. by shifting the base plate 20 along the inclined guides 23, wherein, in case of symmetry, the shifting of the adjustment stands 17' in Y-direction is equal for each pair and, in case of asymmetry, this shifting is different for each pair. In other words, in case of asymmetry, the guides 23, or rather the plates pertaining to a pair of adjustment stands 17' of a bending station that carry said guides, must have different inclination angles.

The apparatus according to the invention can, as explained before, be operated with or without depression/raising unit 8.

Figures 9A, 9B, 9C, 9D, 9E, 9F, 9G, 9H, 9I, 9J, 9K, 9L:
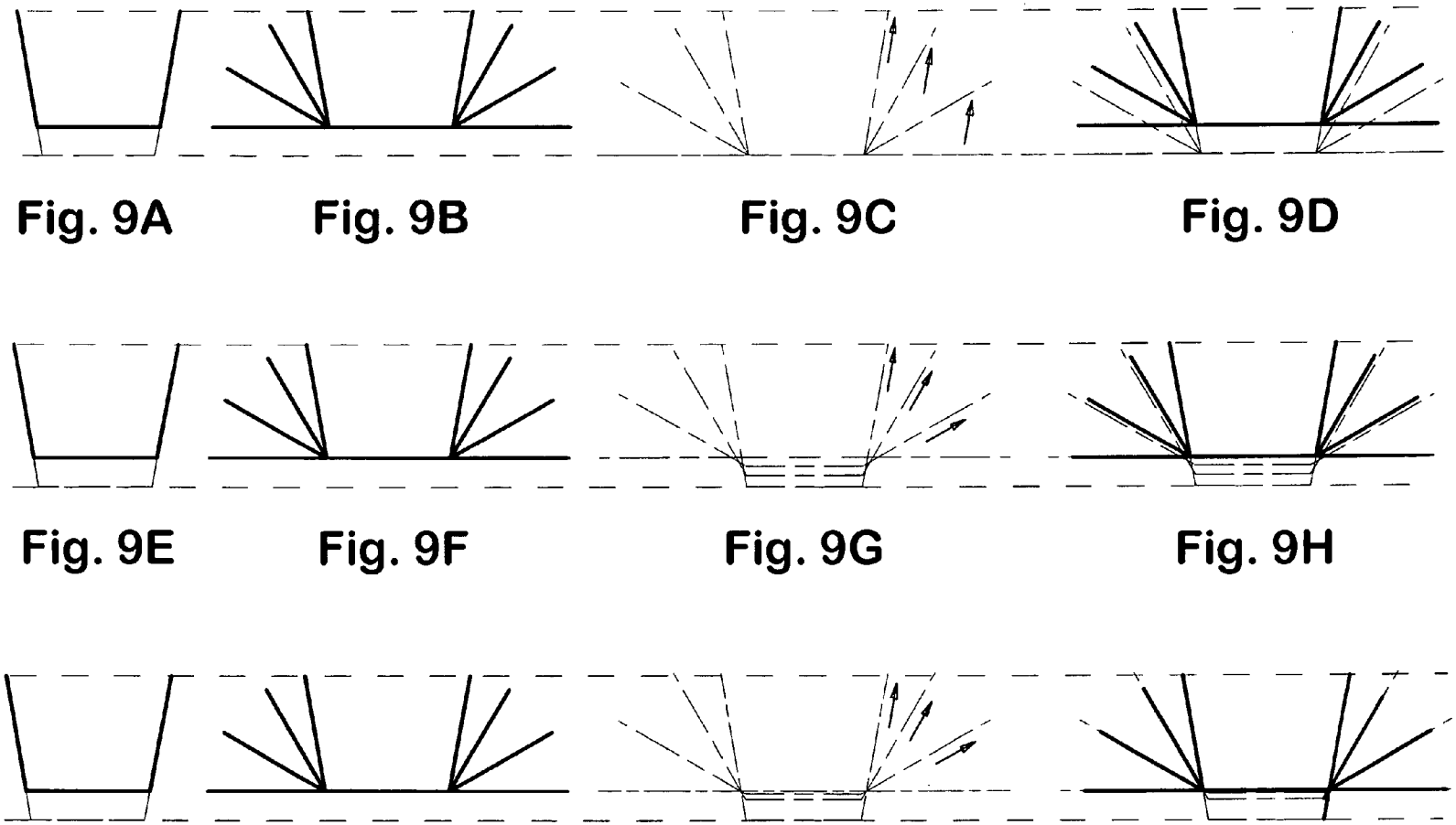
FIGS. 9A to 9D the run of the profile pattern in an operation mode with a depression/raising unit.
FIGS. 9E to 9H the run of the profile pattern in a first operation mode.
FIGS. 9I to 9L the run of the profile pattern in a second operation mode.
Figure 10B:
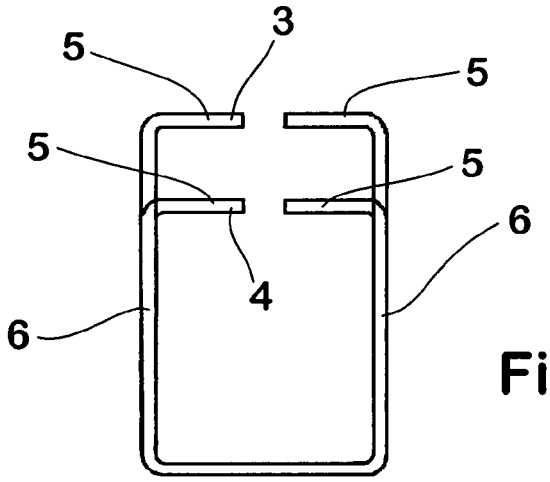
FIG. 10B a front view of a "dummy" profile having varying height according to the prior art, wherein the long legs are bent upwards.
Figure 10A:
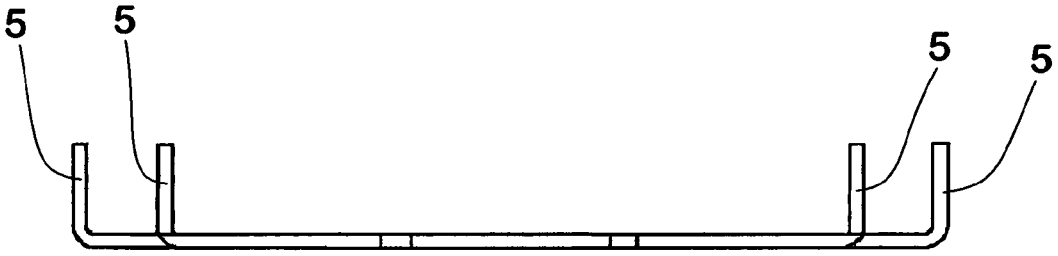
FIG. 10A a front view of a "dummy" profile having varying height according to the prior art, wherein the small elements are bent upwards.

In case of operation with a depression/raising unit 8, in the forming unit 9 only a remainder of the profile, or rather the side edges of the profile, are formed. At that point, the roll pairs are, corresponding to the pre-formed profile (depression or raising), translationally raised or lowered and turned rotationally about an axis. In this operation mode with depression/raising unit 8, all adjustment stands can be mounted and adjusted in a parallel manner. In the operation mode with depression/raising unit 8, the translational movement is conducted parallel to the final cross section of the sheet metal strip. The run of the profile pattern in the above mentioned operation mode is shown in FIGS. 9A to 9D, wherein the continuous line shows the normal cross section and the dashed line shows the cross section with varied height. Particularly, FIG. 9A shows an superposition of the cross sections in the final shape of the profile, FIG. 9B shows the profile pattern of the normal cross section, FIG. 9C shows the profile pattern of the cross section with varied height, and FIG. 9D shows the superposition of the profile pattern of FIGS. 9B and 9C.

In case of operation without depression/raising unit 8, the roll pairs are, according to the desired profile, moved upwards or downwards, and they cause a forming of the bottom and of the cross section of the sheet metal strips in several forming steps for obtaining the finished product having varying height.

In the particular case of an operation without depressing/raising unit 8, in which the profile is varying both in height and in width, the adjustment of the inclination of the plate carrying the guides 23 can, as mentioned before, be carried out either in precise concordance with the inclination angle of the edge to be bent, or by correcting the inclination of said plate while taking in consideration the centrical elongation.

The adjustment stands 17 and 17' of FIGS. 7A and 7B are similar in that the axes of the roll pairs 22 extend in the same direction, i.e. parallel to the sheet metal strip feeding plane X, Y, and in particular parallel to the Y-direction.

Figure 7D:
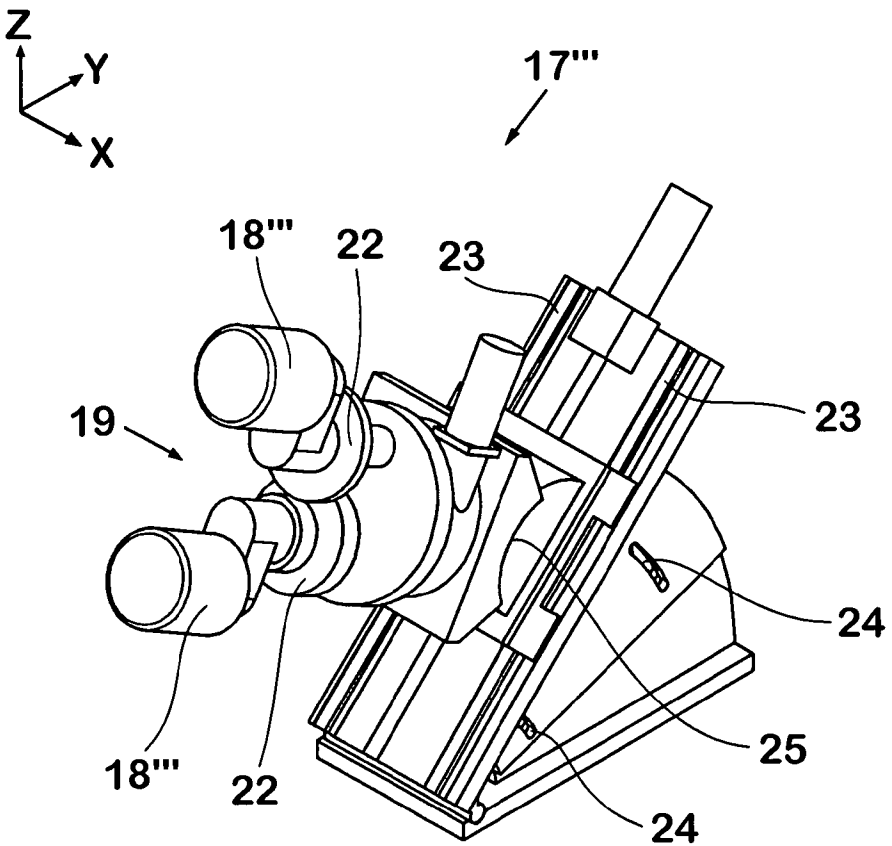
FIG. 7D a variation of the adjustment stand of FIG. 7B.
Figure 7C:
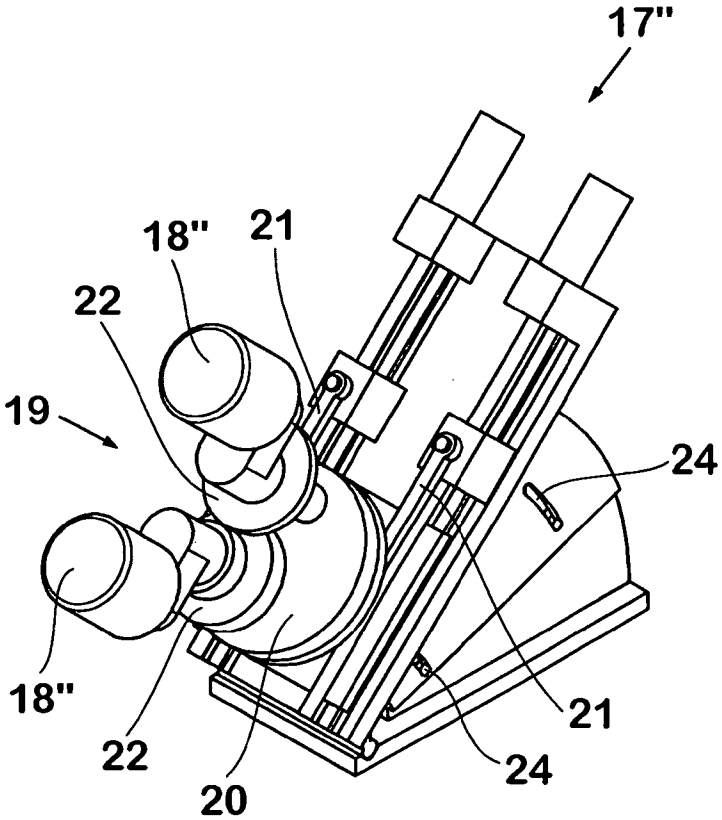
FIG. 7C a variation of the adjustment stand of FIG. 7A.
Figure 8:
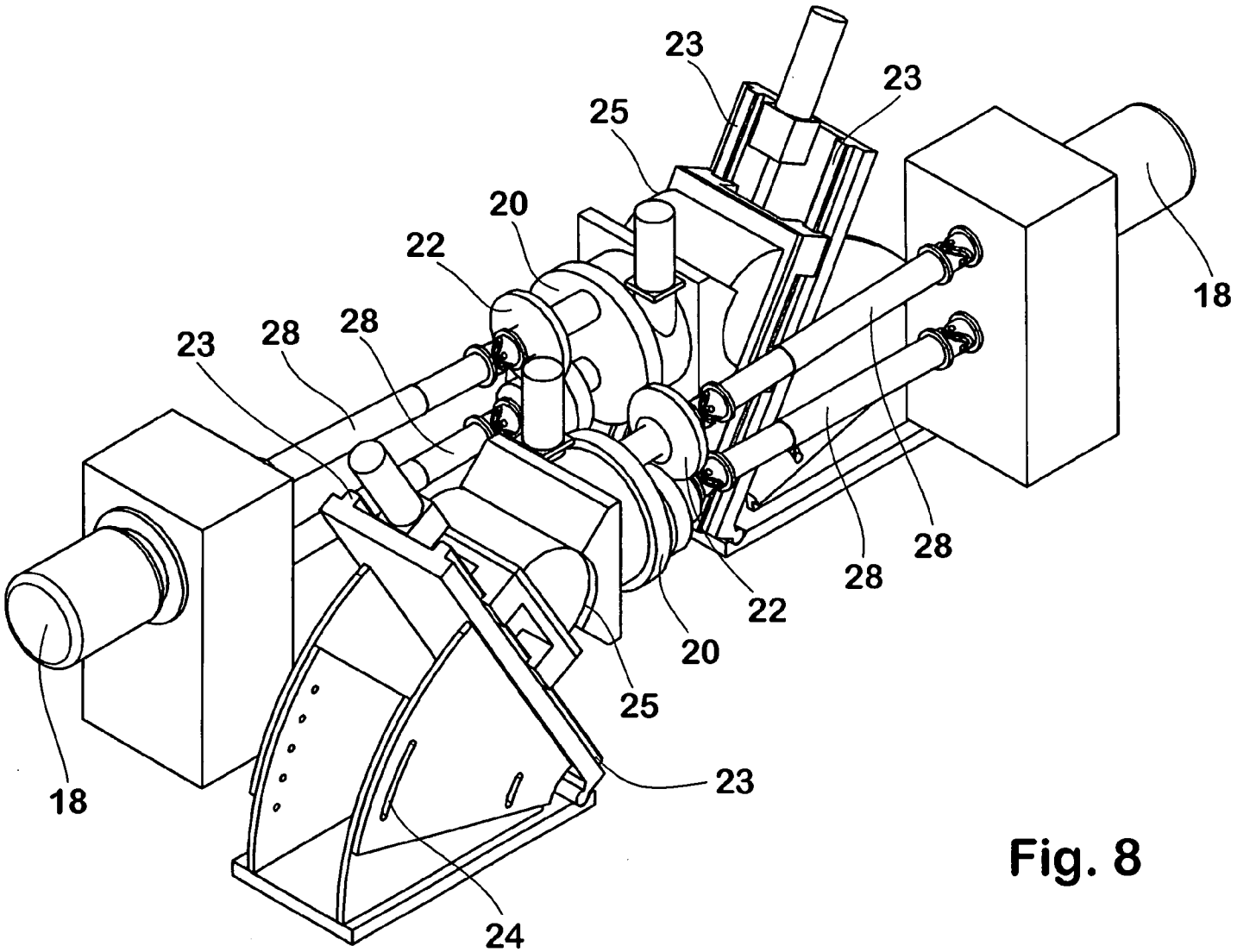
FIG. 8 a pair of bending stations which comprises two adjustment stands of FIG. 7B.

The inventors of the present application have, however, found out that specific advantages can be obtained by modifying the adjustment stands as shown in FIGS. 7C and 7D.

FIG. 7C shows a variation of the adjustment stand of FIG. 7A, wherein the same parts are designated with same reference numerals. The adjustment stand 17" of FIG. 7C comprises, differing from the adjustment stand 17 of FIG. 7A, the mechanism 24 of the adjustment stand 17', whereby the angle of the base plate 20 is adjustable in a direction oblique to the XY-plane. The rolls 22 are, in view of the adjustability of the base plate 20, no longer readily rotatable via shafts, and thus their motorized drive is integrated into the roll stand (roller stand) 19, as designated by reference numeral 18". A suitable motorized drive can be readily implemented by a person skilled in the art in form of a servo motor, an asynchronous machine, a motor with frequency converter or the like, and thus no further explanation is needed.

In the embodiment of FIG. 7C, the roll pair 22 can be displaced from a position in which the axes of the rolls 22 are parallel to the sheet metal strip feeding plane X, Y to a position in which these axes are perpendicular to the sheet metal strip feeding plane X, Y. Thus, the rotational degree of freedom of the adjustment stand 17" lies in a plane such that it is can be turned from a position substantially perpendicular to the sheet metal strip feeding plane X, Y into a position substantially parallel to the sheet metal strip feeding plane X, Y. Hence, it is possible to process sheet metal strips with varying width if the axes of the roll pairs 22 are not parallel to the sheet metal strip feeding plane X, Y, wherein as a result, the bottom of the sheet metal strip is basically uneven and can be adjusted by means of the geometry of the rolls.

FIG. 7D shows a variation of the adjustment stand of FIG. 7B, wherein the same parts are designated with same reference numerals. The adjustment stand 17'" of FIG. 7D has a suitable motorized drive 18'" which is, in analogy to the motorized drive 18" of FIG. 7C, integrated into the roll stand 19. Due to the omission of the shafts 28, the position of the base plate 20 can be adjusted along the circular arc 25 without otherwise applying limitations so that it is, in analogy to the embodiment of the adjustment stands of FIG. 7C, for the case of FIG. 7D also possible to displace the roll pair 22 from a position in which its axes are parallel to the sheet metal strip feeding plane X, Y into a position in which its axes are perpendicular to the sheet metal strip feeding plane X, Y. From this results an effect which is analogous to that of the adjustment stand of FIG. 7C.

The adjustment stands 17" of FIG. 7C as well as the adjustment stands 17'" of FIG. 7 can, as shown in FIG. 8, be arranged in pairs one after another and in a staggered manner.

FIGS. 9E to 9H show the run of the profile pattern with correction of the inclination of the plate carrying the guides 23 in dependency of the centrical elongation at the bending point of the sheet metal, wherein the continuous line shows the normal cross section and the dashed line shows the cross section with varied height. In particular, FIG. 9E shows the superposition of the cross sections in the final shape of the profile, FIG. 9F shows the profile pattern of the normal cross section, FIG. 9G shows the profile pattern of the cross section with varied height and FIG. 9H shows the superposition of the profile patterns of FIGS. 9F and 9G As to be seen from FIGS. 9G and 9H, owing to the correction in dependency of the centrical elongation, the depressing and the raising of the bottom of the profile takes place in approximately equal steps. FIGS. 9I to 9L correspond to FIGS. 9E to 9H, with the difference that no to correction in dependency of the centrical elongation was performed, and thus the depressing and raising of the bottom of the profile is performed in differing non-linear steps, which results in an increase of the strain as compared to the embodiment with correction in dependency of the centrical elongation.

The rolls of a roll stand are, in their most basic form, cylindrical and have parallel axes, as shown in the DE 100 11 755 A1 mentioned above, and the rotation axis of such a roll stand is perpendicular to the movement direction, or perpendicular to the direction of the variability of the cross section of the profile.

The rolls of a roll stand are, however, not necessarily cylindrical, but may have varying diameters over their length, as shown in FIGS. 5, 7, and 8, for providing the sheet metal strip partially with a determined profile. In this case, the rotation axis of the roll stand is also perpendicular to the movement direction or perpendicular to the direction of the variability of the cross section of the profile.

The latter phrasing is construed to comprise the case that the rolls of one of the roll stands do not have parallel axes, but that their axes are more or less inclined to each other. This can be necessary to prevent or reduce collisions.

Figure 11A:
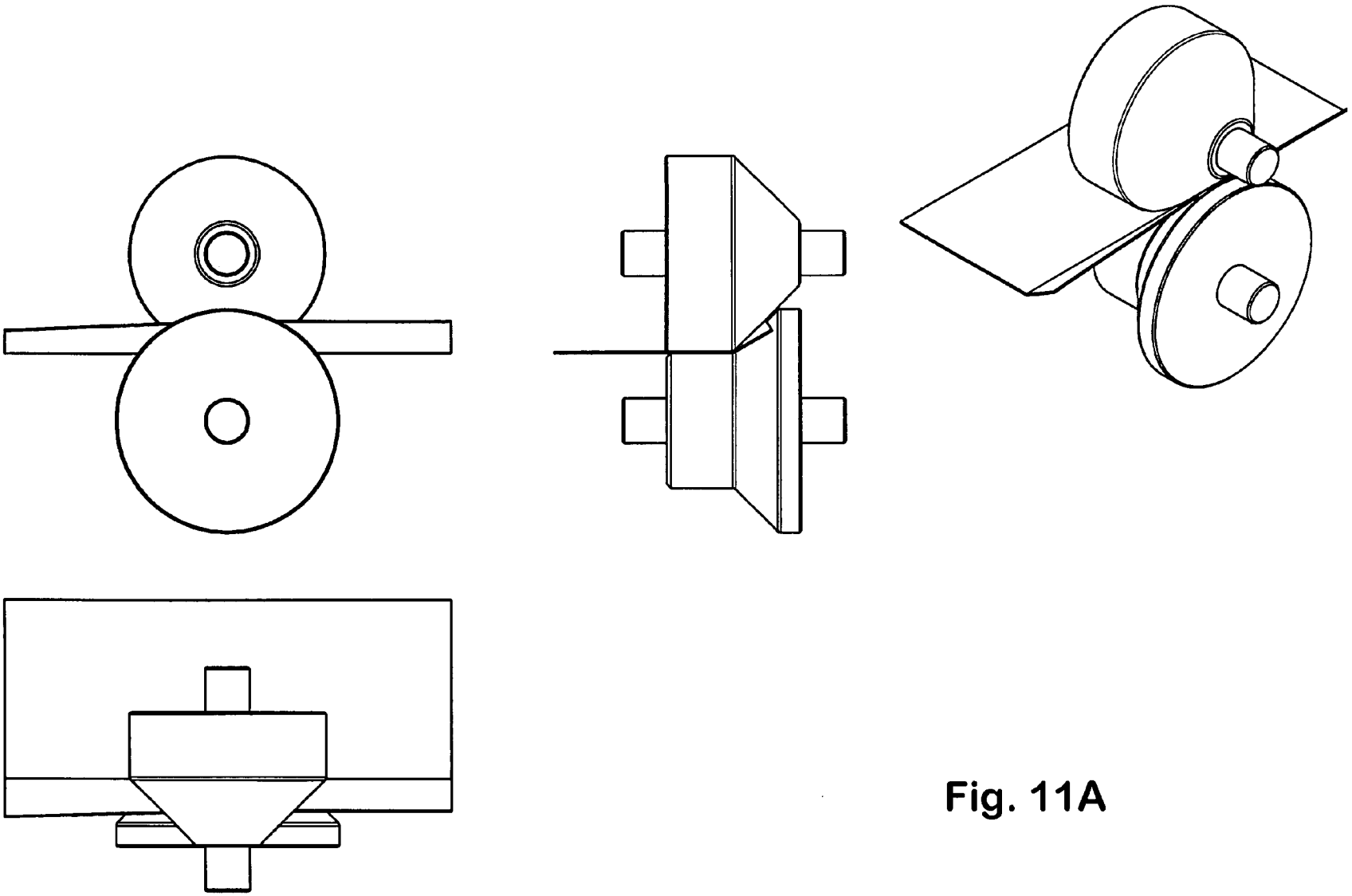
FIGS. 11A to 11D some possible variations out of many for the structure and the arrangement of the rolls of an adjustment stand.
Figure 11B:
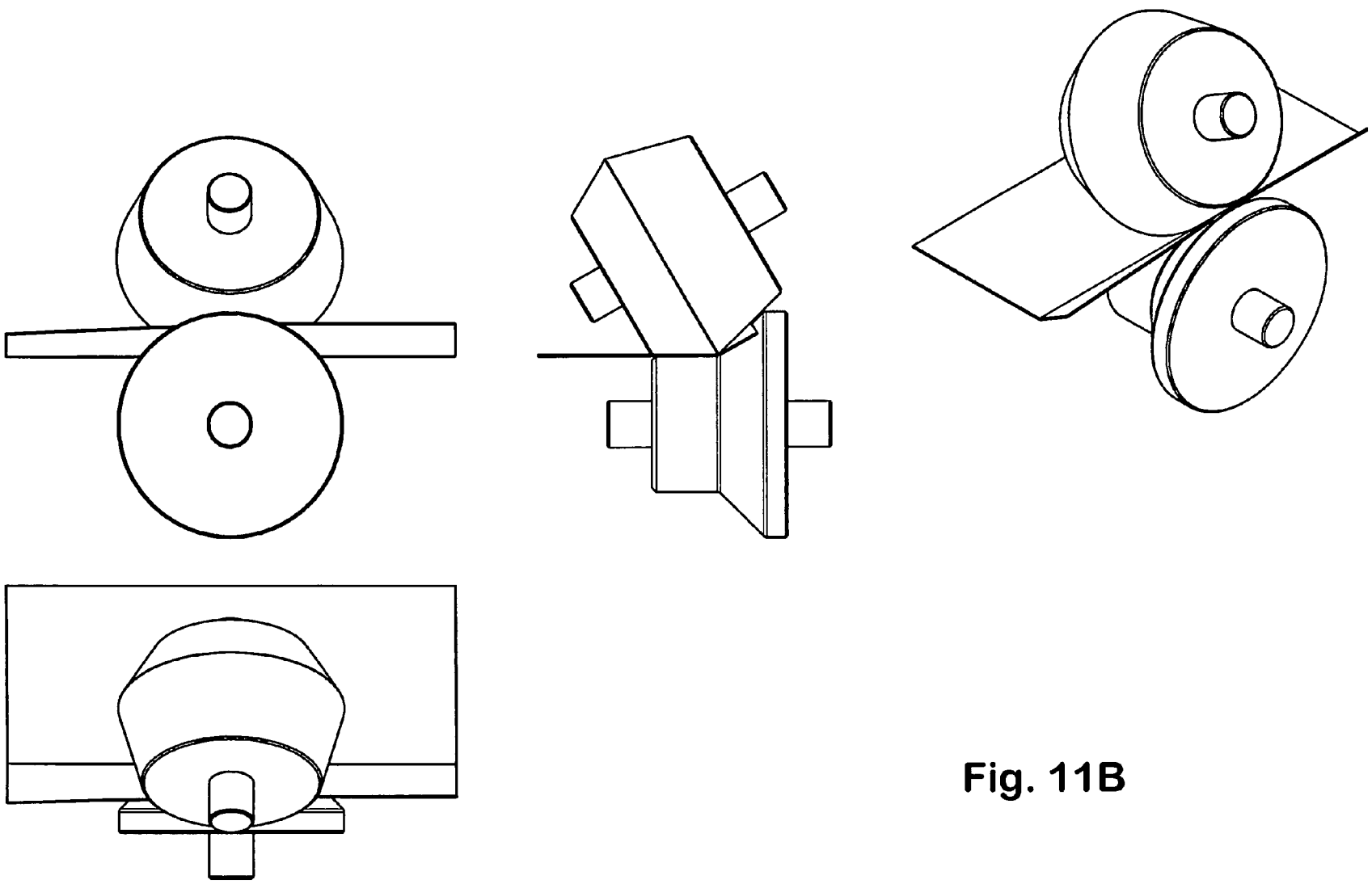
Figure 11C:
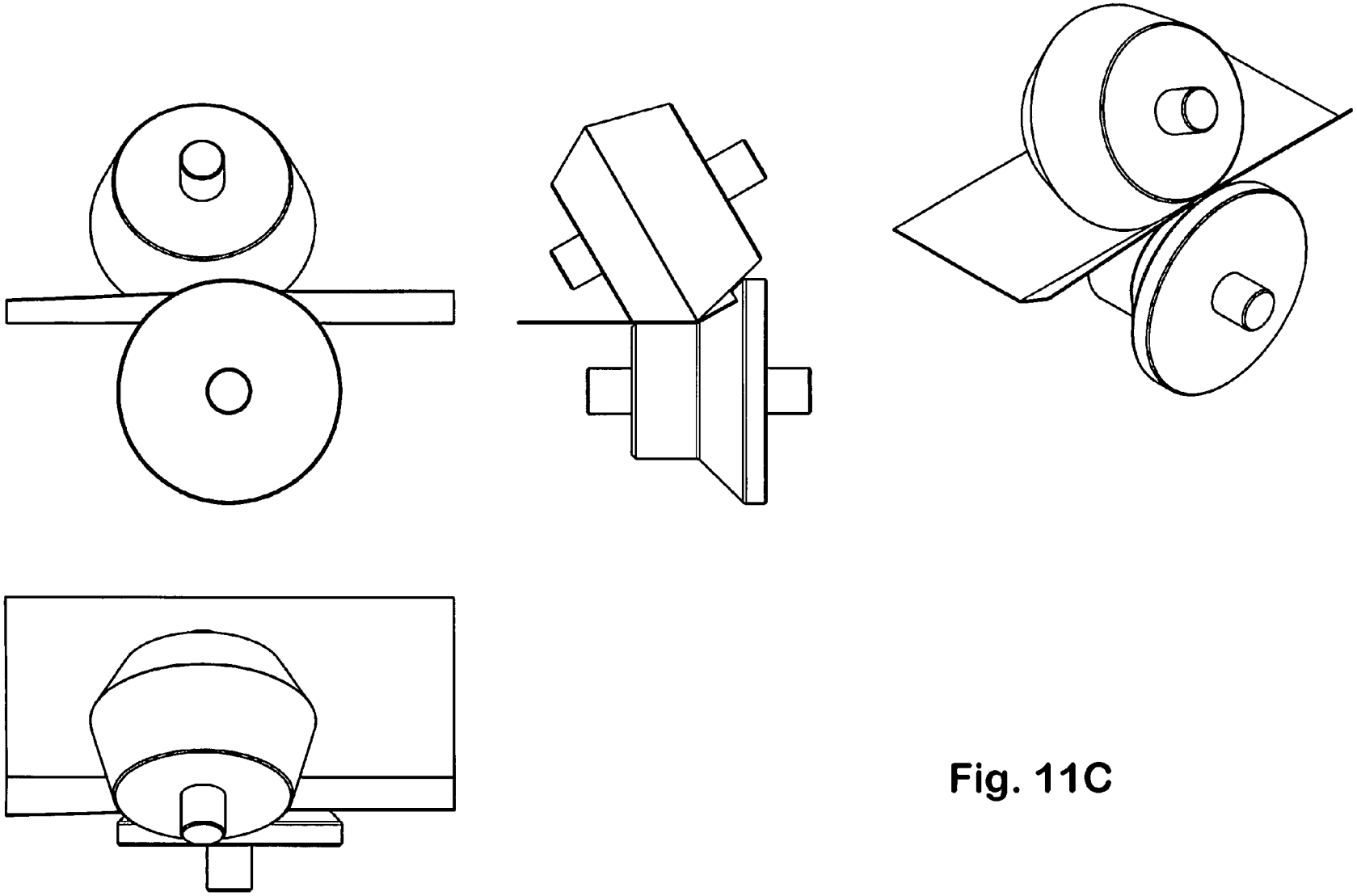
Figure 11D:
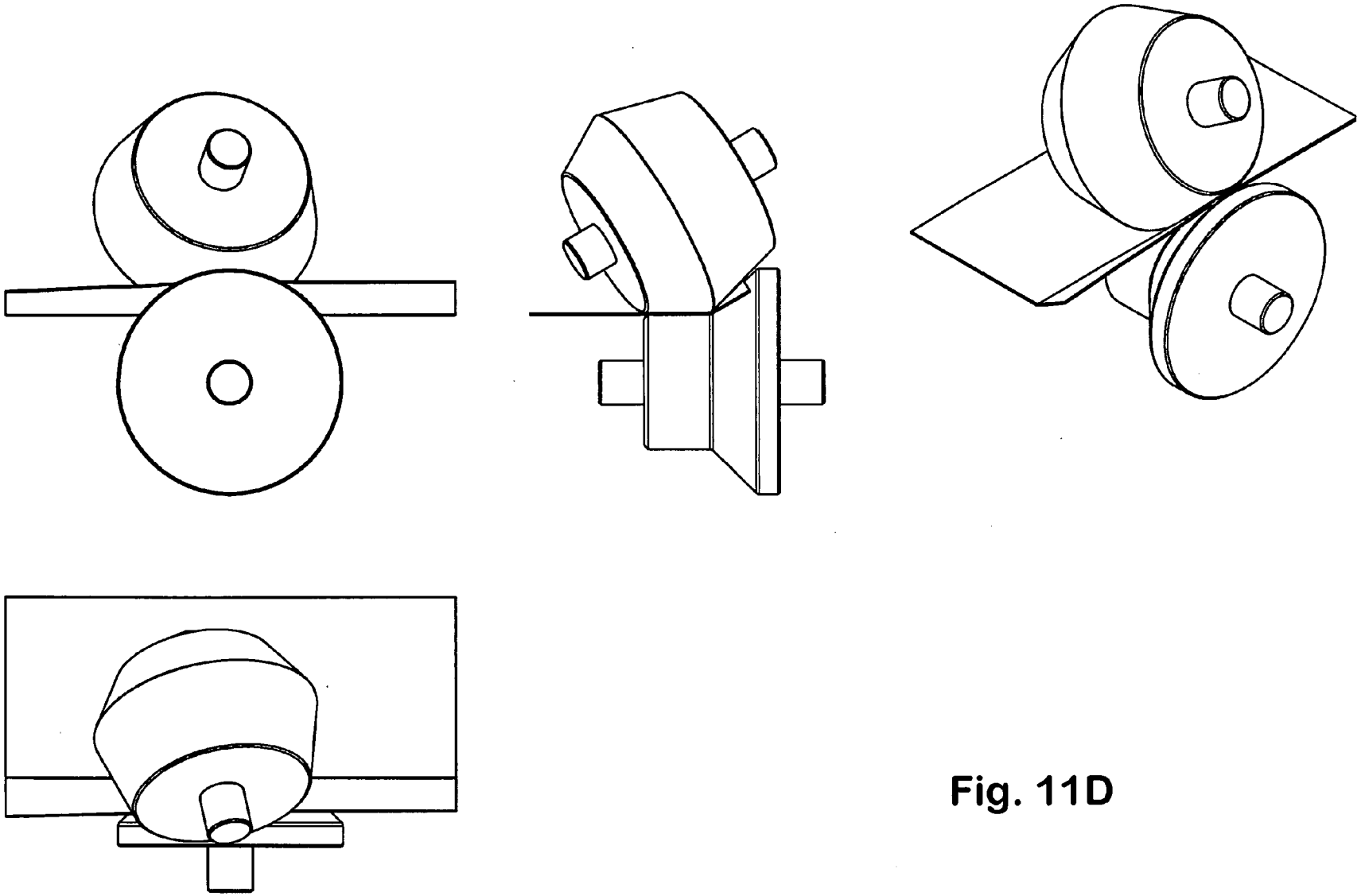

FIGS. 11A to 11D show one out of many possible variations for the structure and the arrangement of two rolls of a roll stand. Among these, FIG. 11A shows a classical arrangement, i.e. with parallel axes of the rolls which have complementary varying diameters between which a sheet metal strip is passed; FIG. 11B shows an arrangement in which the axis of one of the rolls is parallel to the sheet metal strip feeding plane and the axis of the other roll is inclined to it, FIG. 11C shows an arrangement in which the axes of the rolls are not only inclined to each other, but also offset in respect to each other in the sheet metal strip transport direction; and FIG. 11D shows an arrangement in which the axes of the rolls are inclined to each other, are offset in respect to each other in the sheet metal strip transport direction, and additionally are skewed to each other about the upward ordinate axis (a line which more or less passes radially through both rolls).

In FIGS. 11B to 11D, each time only one axis is modified as compared to FIG. 11A, but it is also possible to modify the position of the other axis or of both axes. In principle, it is possible to shift and skew one or both axes in all three spatial directions.

Possible reasons for modifying the position of the axes are:

Not enough installation space is available. This may be the case especially when the forming is carried out in a flexible manner, if each roll has an individual drive. At the backside of the rolls, there are to be accommodated a robust bearing, possibly a transmission, and the drive motor. By the skewing, free space is provided at the backside of the roll stand.

During the forming process, it is often the case that one of the rolls makes contact earlier with the sheet metal. From the FIGS. 11A and 11B, it is to be seen that the sheet metal makes contact with the lower roll clearly in front of the plane that goes through the axes of both rolls, which is why the forming process commences already in front of this plane. For compensating or utilizing this fact, it is possible to shift the other roll to the front or to the back of the plane going through the hitherto axes of both rolls, as shown in FIG. 11C.

If the sheet profile in the length direction is not passed horizontally through the machine, which here is referred to as depressing within the machine, it is thoroughly reasonable that the plane defined by the axes of both rolls is perpendicular to the sheet metal surface. Otherwise, the sheet metal is forced into a horizontal position between the rolls, and directly afterwards the sheet metal moves on downward.

By shifting the points of action of the rolls, forces can be reduced. Thus, the machine can be built more lightweight, or for a given design the deformation of the stands can be reduced.

The size and the shape of the rolls can be altered by modifying the position of the axes. As a result, the weight can be reduced and material can be saved.

If a roll has very large differences in diameter, as seen over its profile, very large differences of the circumferential speeds result therefrom. Scratches or other damages of the surface may result therefrom. This can partially or completely be compensated by modifying the position of the axis of the roll.

If technical features stated in any of the claims have been designated with reference numerals, these numerals where included solely for a better comprehensibility of the to claims. Accordingly, these reference numerals have no limiting effect on the scope of each element exemplified by such reference numerals.

The invention claimed is:

1. Apparatus for producing a profile with varying height by means of cold roll forming, said apparatus comprising a forming unit having a least one adjustment stand, the adjustment stand comprising:

a roll stand including a base plate, a pair of paraxial rolls extending from the base plate and disposed in one plane, and a pair of push rods coupled to the base plate each of the paraxial rolls defining an axis and being rotatable about the axis;

a gap defined between the pair of paraxial rolls, the gap configured to pass a sheet metal strip therethrough, wherein the pair of push rods is configured to translationally displace the base plate with at least one translational degree of freedom and wherein the pair of push rods is configured to rotationally displace the base plate with at least one rotational degree of freedom, wherein the base plate is configured to be rotationally displaced by one of said push rods and rotates about an axis of rotation extending paraxially between the axes of the rolls, wherein the rotational degree of freedom is uncoupled from the at least one translational degree of freedom.

2. The apparatus according to claim 1, wherein the roll stand is adjustable such that the axis of rotation of the roll stand is movable between being parallel and inclined to a plane along which the sheet metal strip is fed through the gap.

3. The apparatus according to claim 1 wherein the rotational axis of the base plate is perpendicular to the sheet metal strip transport direction (X).

4. The apparatus according to claim 1, wherein the rotational axis of the base plate is pivotable in a plane (Y,Z) perpendicular to the sheet metal strip transport direction (X).

5. The apparatus according to claim 1, wherein said translational degree of freedom is perpendicular to the plane (X,Y) of feeding of the sheet metal strip so that the adjustment stand adjustable in height relative to the sheet metal strip feeding plane (X,Y).

6. The apparatus according to claim 1, wherein the adjustment stand has a second translational degree of freedom, wherein the translational degrees of freedom are in a plane (Y,Z) perpendicular to the sheet metal strip transport direction (X) so that the adjustment stand is adjustable in height relative to the sheet metal strip feeding place (X,Y) and, in direction perpendicular thereto, in the distance relative to a longitudinal center line of the sheet metal strip.

7. The apparatus according to claim 6, wherein the inclination angle of the base plate is adjustable relative to the sheet metal strip feeding place (X,Y) in accordance to an inclination angle of an edge to be bent of the sheet metal strip.

8. The apparatus according to claim 7, wherein the inclination angle of the base plate carrying the rolls is adjusted while taking into consideration the centrical elongation at the edge to be bent of the sheet metal strip.

9. The apparatus according to claim 8, further comprising a driving unit, arranged upstream from the depression/raising unit in sheet metal strip transport direction (X), which is configured to prevent a backwards pulling force before a depressing/raising and to compensate the change of length of the sheet metal strip in the depressing/raising unit.

10. The apparatus according to claim 1, further comprising a unit for cutting a sheet metal strip in the width (Y) corresponding to the varying height (Z) and/or width of the profile.

11. The apparatus according to claim 1, further comprising a driving unit, arranged upstream from a depression/raising unit, arranged upstream from the forming unit in sheet metal strip feeding direction (X), which is configured for forming a depression and/or a elevation in the sheet metal strip.

* * * * *